United States Patent [19]

Hollner

[11] Patent Number: 4,563,006

[45] Date of Patent: Jan. 7, 1986

[54] ICE-HOCKEY STICK HAVING BEVELLED LOWER SURFACE

[76] Inventor: Karl O. S. Hollner, Skaldvägen 6, 183 43 Täby, Sweden

[21] Appl. No.: 599,716

[22] Filed: Apr. 12, 1984

[30] Foreign Application Priority Data

Apr. 29, 1983 [SE] Sweden ..... 8302451
Oct. 13, 1983 [CA] Canada ..... 438894

[51] Int. Cl.[4] ..... A63B 59/14
[52] U.S. Cl. ..... 273/67 A
[58] Field of Search ..... 273/67 A, 67 R, 67 D, 273/67 DC; D21/210–213

[56] References Cited

FOREIGN PATENT DOCUMENTS 906020 7/1972 Canada ..... 273/67 A
2362218 7/1975 Fed. Rep. of Germany ... 273/67 A

*Primary Examiner*—Richard C. Pinkham
*Assistant Examiner*—Matthew L. Schneider
*Attorney, Agent, or Firm*—LeBlanc, Nolan, Shur & Nies

[57] ABSTRACT

An ice-hockey stick, preferably with a blade (1) slightly curved in its longitudinal direction, where the concave side (3) of the blade obtained by said curve is the forehand side. The stick is particularly characterized in that the lower side (2) of the blade (1) is bevelled or correspondingly worked along a substantial part of the length of the blade (1) and substantially slopes from the forehand side (3) to the backhand side (4) of the blade, so that the blade (1) is lower, shorter, on the forehand side (3) than on the backhand side (4).

17 Claims, 14 Drawing Figures

ICE-HOCKEY STICK HAVING BEVELLED LOWER SURFACE

BACKGROUND OF THE INVENTION

This invention relates to an ice-hockey stick, which has the blade preferably bent in its longitudinal direction.

The stick according to the invention is improved over known sticks in the respect that it provides the possibility of shooting straighter and harder forehand shots and to render high, straight and hard backhand shots easier. Due to the configuration of the blade, among other things, the tendency of the puck to rotate in the air after a shot is counteracted.

The invention, thus, relates to an ice-hockey stick, preferably with a blade slightly curved in its longitudinal direction wherein the side of the blade that is concave due to the longitudinal curvature is the forehand side.

The ice-hockey stick is especially characterized in that the lower side of the blade is bevelled or correspondingly worked along a substantial portion of the blade length and substantially slopes from the forehand side to the backhand side of the blade, so that the blade is lower, shorter on the forehand side than on the backhand side.

BRIEF DESCRIPTION OF THE DRAWINGS

The invention is described in greater detail in the following, with reference to a pair of embodiments and to the accompanying drawings, in which FIGS. 1*a–c* schematically show the cross-section of the blade of three prior art stick types.

DETAILED DESCRIPTION OF THE DRAWINGS

Figure 1:
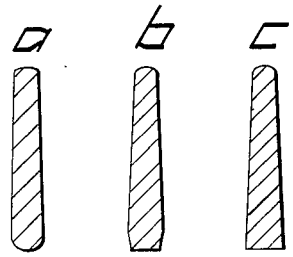
Figure 2:
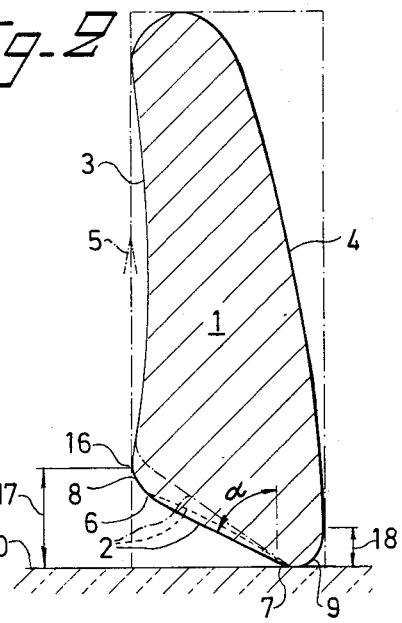
PRIOR ART Fig. 2
FIG. 2 shows a first embodiment of a stick according to the invention where a cross-section of the blade is shown, FIG. 3 schematically shows the cross-section of the blade of the stick according to FIG. 2 in contact with a puck, where two different positions during a forehand shot are shown in the Figure.
Figure 3:
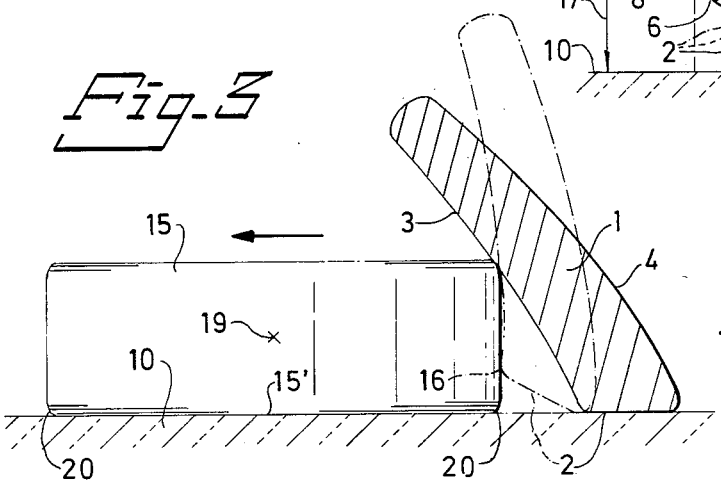
Figure 7:
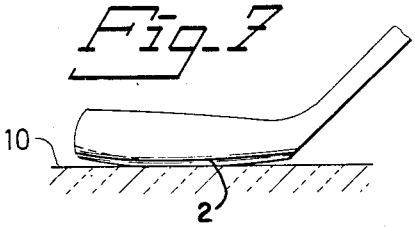
FIG. 7 shows the stick according to FIGS. 4–6 seen from its forehand side and held substantially vertically, corresponding to the dashed position in FIG. 3.

The prior art stick blade designs shown in FIGS. 1*a–c*, show blades 1 having lower sides 2 that are rounded, slightly bevelled from two directions or substantially perpendicular and substantially symmetrical with respect to the forehand side and backhand side of the blade. In a stick according to the invention, which as to its overlapping form is known and preferably comprises a blade slightly curved in its longitudinal direction, and the concave side of the blade obtained by said bending is the forehand side 3, FIG. 3, the lower side 2 of the blade 1 is bevelled along a substantial part of the blade length and slopes from the forehand side 3 to the backhand side 4, as shown in FIGS. 2 and 3, so that the blade 1 is lower, shorter, on the forehand side than on the backhand side. The lower side 2 preferably is bevelled substantially along the entire length of the blade, as shown in FIG. 7. The lower side 2 can be plane as shown by fully drawn line in FIG. 2, or concave from below in the direction of the thickness of the blade, as shown by dotted line in FIG. 2.

The stick according to the invention provided with bevelled lower side 2 is shown in FIG. 2 in a blade design, which in remaining respects is normal, where the blade 1 tapers upward and at least at certain portions in the longitudinal direction of the blade is curved slightly to the forehandside 3, so that the forehand side is slightly concave and the backhand side is slightly convex.

The height direction of the blade here is to be understood as a tangent 5 to the forehand side 3 of the blade. The forehand edge 6 of the blade is to be understood as the line, at which the forehand side 3 transforms to the lower side 2, and in a corresponding way the backhand edge 7 is to be understood as the line, at which the backhand side 4 transforms to the lower side 2. 8 and, 9 designate the lower portion of side 3 and, 4 respectively adjoining the respective edges 6 and 7. The design of the transition portions 8,9 will be dealt with in the following. The position shown in FIG. 2 defines what hereinafter will be called the vertical position of the blade, i.e. a position where the height direction of the blade is vertical and thereby perpendicular to the ice. It should be noted that the definition vertical position of the blade refers to a certain cross-section of the blade and not to the direction of the entire blade. There is a difference in this respect, because usually most of the blades are slightly twisted in longitudinal direction.

As shown in FIG. 2, when the blade is placed on the ice 10, an angle $\alpha$ is formed between a perpendicular line extending from the ice 10 and the plane defined by the lower side 2 of the beveled blade. The angle $\alpha$ is in the range of about 30°–80°, and preferably in the range 50°–60°. The said range, about 30°–80°, corresponds at normal blade thicknesses substantially to a difference in height between the forehand side and backhand side of about 2–15 mm. A preferred difference in height is about 5 mm. When the blade is placed vertically to the ice 10, the forehand edge 6 will be located about 2–15 mm, preferably about 5 mm above the ice.

According to a first embodiment of a stick according to the invention, as shown in fully drawn lines in FIGS.

Figure 6:
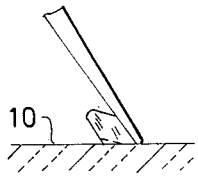
FIG. 6 shows the blade end according to FIG. 4 seen from the right in FIG. 4.
Figure 4:
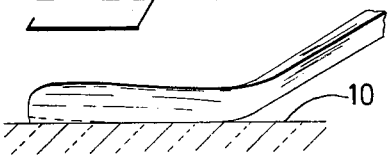
FIG. 4 shows the blade end of the stick of two embodiments of the stick according to the invention, seen from its forehand side, corresponding to a view seen from the left in FIGS. 2 and 3 and inclined to the ice, as indicated by fully drawn line in FIG. 3.
Figure 5:
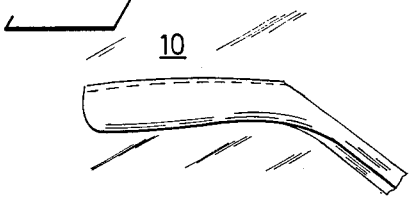
FIG. 5 shows the blade end of the stick according to FIG. 4 seen from above in FIG. 4.
Figure 8:
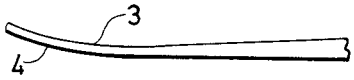
FIG. 8 shows the stick according to FIG. 7 seen from below in FIG. 7, FIG. 9 schematically shows the cross-section of a stick blade according to the invention in contact with a puck, where two different positions during a backhand shot are shown.

2–7, the said bevelling is so adjusted along the blade 1, that there is a definite plane, which comprises at least the forehand edge 6 and the backhand edge 7 of the blade 1 along substantially the entire bevelled length of the blade, which plane, thus, forms an acute angle with the height direction of the blade, whereby there is a well-defined position, shown in FIGS. 4–6, where the bevelled lower side 2 of the blade, or at least the edges 6,7, abut the ice 10 or corresponding support, and where the blade 1 to a predetermined extent is inclined to the forehand side. In normal blade designs, where the thickness or width of the blade, as shown in FIG. 8, substantially continuously decreases to the tip from the rear portion of the blade, the difference in height between the forehand side and backhand side substantially continuously decreases from the rear portion to the tip, as marked fully drawn in FIG. 7.

According to a second embodiment of a stick according to the invention, the height difference between the backhand edge 7 and forehand edge 6 to the tip increases so that the forehand edge 6 at the well-defined position described with reference to the first embodiment no longer is located on the ice 10 along substantially the entire bevelled length of the blade. Instead the distance of the forehand edge 6 to the ice increases continuously to the tip at the forward portion of the blade where the curvature of the blade is greatest. This embodiment is indicated by dash-dotted lines in FIGS. 2 and 3, where the blade 1 is seen in the direction to the tip, and where for the sake of clearness the curvature of the blade is not shown, and by dashed lines in FIGS. 4,6 and 7.

According to a third embodiment, which is a special case of the second embodiment, the distance of the forehand edge to the ice increases substantially continuously to the tip from the rear portion of the blade to its forward portion as the total deflection of the blade, due to the curve of the blade, increases. According to a fourth embodiment, which is a special case of the second embodiment, the said height difference substantially continuously decreases or is constant all the way to the forward portion of the blade and thereafter increases continuously to the tip.

At said second to fourth embodiments, the blade is designed so that at said well-defined position only the backhand edge abuts the ice along a substantial part of the blade length, owing to said variation in height difference, whereby there is a plane comprising the backhand edge, and the proportion of the plane of the blade length can be varied.

It is, of course, possible to imagine several combinations of height differences decreasing, being constant or increasing to the tip. Preferred combinations, however, as will become apparent from the following, are those where the height difference increases at the forward portion of the blade.

Figure 12:
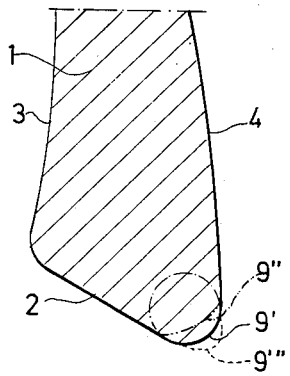
Figure 13:
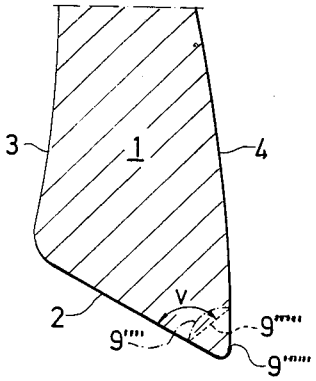
Figure 14:
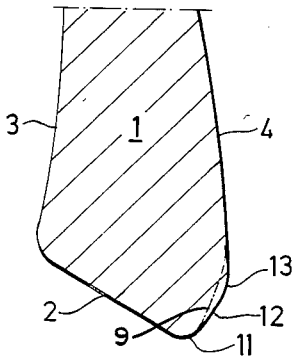
FIG. 14 shows a preferred embodiment of said portion of the backhand side of the blade.

In FIGS. 12–14 different embodiments of the lower portion 9 of the backhand side adjoining the backhand edge 7 are shown. FIG. 12 shows different curved designs where 9' is part of a circle forming a relatively blunt portion, 9'' a more blunt form and 9''', a more acute form than the circle form 9'. In FIG. 13 a concave design 9'''' a rectilinear design 9''''', and a very acute design 9'''''', are shown. In FIG. 14 a preferred embodiment is shown where a substantially circular portion 11 adjoins the backhand edge and transforms to a linear portion 12 forming a bevelling of said lower portion 9, which later portion 12 via a substantially circular portion 13 adjoins the upper portion of the backhand side, as appears from FIG. 14.

The function of the ice-hockey stick according to the invention is as follows. The function is linked to a substantial extent to the height of impact on a puck 15 abutting the blade, which is to be understood as the distance to the ice 10 or the lower side 15' of the puck from the lowermost point 16, FIG. 3, which has contact with the blade. In FIG. 2 the numeral 17 designates the height of impact on the forehand side 3 with the blade in vertical position, and 18 designates the impact height on the backhand side 4 with the blade in vertical position.

Figure 11:
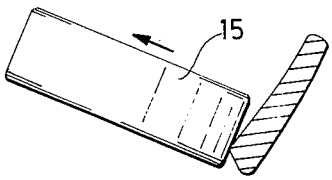
FIG. 11 shows the completion of a forehand shot, FIG. 12 schematically shows three embodiments in respect of the configuration of the lower portion of the backhand side of the blade adjoining the backhand edge of the blade, FIG. 13 schematically shows additional embodiments of said portion of the backhand side of the blade.

At the preparation of a forehand shot, also called forehand sweep shot, and during the drawing moment of such a shot, illustrated fully drawn in FIG. 2, the lower side 2 of the stick, at least the edges 6,7 or only one edge 7, the backhand edge, abuts the ice 10 in a well-defined way by means of the support surface/support edge of considerable size which the lower side 2 constitutes. It is hereby possible to carry out the drawing moment in a predetermined uniform way at each shot, which is very essential and increases the proportion of successful shots. The final moment of the shot is started by turning the blade 1 to a position, shown dashed in FIG. 3, where there is greatest possible contact between the forehand side 3 of the blade and the puck, and the blade assumes a substantially vertical position corresponding to the position in FIG. 7. Due to the bevelling, the blade does not abut the puck at the puck portion closest to the ice, but contact prevails from a point 16 located slightly below the centre of gravity 19 of the puck, which refers, as mentioned, to the lowermost point 16 in contact with the puck 15. Due to the contact concentrated about the centre of gravity, the puck is prevented from rotating. Instead a straight and hard shot is effected. The impact imparted to the puck at the initiation of the final moment of the shot by the well-defined upward-turning of the blade, should also contribute to the effect of a hard shot. At completion of the shot, FIG. 11, the point contact adjoining the centre of gravity should contribute to the prevention of rotation. The above description of a forehand shot refers to a definite position along the blade 1. According to an occurring shooting technique, during the later part of the shot puck rolls in the direction to the blade tip. At the forward portion of the blade, however, the strong outward deflection, as a result of the curvature of the blade and the frequently occurring rearward turning of the blade, has the effect that the tendency of the puck to rotate rearward, which rotation reduces considerably the possibility of making a straight and hard shot, is greater when the puck leaves the blade at or in connection to the tip than when the puck leaves the blade at the rear or central part thereof. For counteracting this, an extra high impact height is required, which is effected by an increase of the height difference between the backhand side and forehand side as described with reference to the embodiments two—four according to above. The rolling of the puck upward on the blade is also counteracted by the increase in height difference. It is also suitable that the blade is twisted forward on the forehand side also adjoining the tip. As the impact height at the forward portion of the blade is high, also the angle $\alpha$ is small, which implies that at heavy inclination of the blade to the backhand side the impact height, after a certain boundary position in respect of said inclination has been passed, is moved closer to the ice (lower side of the puck), whereby the puck, with the blade thus inclined, can be lifted steeply upward with the lower side 2 of the blade at the forward portion of the blade.

Figure 9:
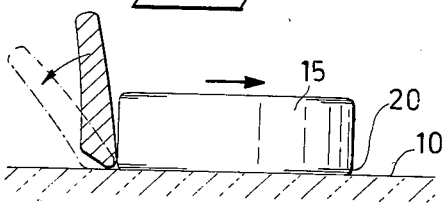
Figure 10:
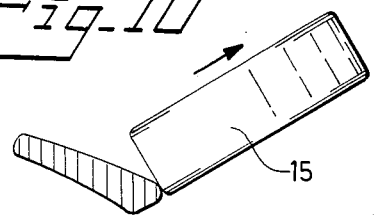
FIG. 10 shows the finishing part of the shot according to FIG. 9.

The impact height 17 on the forehand side, thus, depends on the angle $\alpha$, but can also be influenced by the design of the lower portion 8 of the forehand side adjoining the forehand edge 6 and lower side 2. The impact height on the backhand side 4 is affected by the design of the lower portion 9 of the backhand side, as described with reference especially to FIGS. 12–14. The intention is that at substantially all imaginable inclinations of the blade in relation to the puck the direction of the force, by which the blade acts on the puck, in spite of heavy inclination of the blade to the forehand side shall pass through or slightly below the centre of gravity 19 of the puck and not above the centre of gravity. At backhand draw shots the final moment of the shot is initiated in that the blade is turned from a position (not shown) inclined to the right in FIG. 9 to the fully drawn position, whereby the puck, preferably by means of an intermediate position, dashed in FIG. 9, of the blade can be lifted for example as in FIG. 10, whereby a high, hard and straight backhand shot is effected. In the way described shots are made at a definite position in the longitudinal direction of the blade.

At the curved shape of the lower portion of the backhand side, FIG. 12, the circular design 9' implies that the impact height on the puck is constant when the inclination of the blade is varied. At the slightly more acute, 9''', and, respectively, more blunt, 9'', design the impact height decreases and, respectively, increases when the inclination of the blade to the forehand side is increased continuously until the lower side 2 of the blade lies on the ice.

At the linear, 9''''', or concave, 9'''', design of the lower portion 9, FIG. 13, the impact height increases when the angle v between the lower side and portion 9 (9'''', 9''''') is $\geqq 90°$, and the blade successively according to above is inclined to the forehand side. When the angle is $<90°$, the impact height first will increase and thereafter, at the passing of the boundary position concerning inclination to the forehand side, jumpingly decrease. At the more acute embodiment, 9'''''', the function is substantially the same as at the acutest, 9''', in FIG. 12. At the embodiment according to FIG. 14, the function is substantially the same as at the linear, 9''''', and the concave one, 9'''', according to FIG. 13.

According to a preferred embodiment, the lower portion 9 of the backhand side, seen in the longitudinal direction of the blade, designed so that the impact height on the backhand side with the blade in vertical position is substantially continuously increasing from the rear portion of the blade to the tip, as indicated dashed in FIGS. 5 and 14. Backhand shots at a definite position in the longitudinal direction of the blade are preferabl carried out at the rear, slightly more straight portion of the blade where the impact height is relatively low, whereby the puck can be easily caused to leave the ice, i.e. the lifting-off of the puck is facilitated.

At another usual shooting technique for backhand shots, the puck is allowed to roll along the blade from the rear to the forward portion, whereby the puck rolls along the forward portion when the blade leaves the ice. Hereby no low impact height is required for lifting the puck, but instead a higher impact height at the forward portion of the blade is required in order to prevent rearward rotation of the puck in a way corresponding to forehand shots. Here, thus, an impact height increasing to the tip is suitable. The rolling-up of the puck on the blade also is affected by the impact height increasing to the tip. It can be imagined that the impact height is changed in a different way in the longitudinal direction of the blade in the direction to the tip, for example that it is constant or substantially continuously decreasing. It also is imaginable that at a certain blade positions the impact height is changed in two or more of the ways mentioned, and that each type of change covers a substantial portion of the blade length. A suitable impact height on the backhand side is in the interval 1–5 mm.

As should have appeared from the aforesaid, according to the invention a better ice-hockey stick is obtained by very simple means, viz. the bevelling of the lower side. The stick implies both better forehand and backhand draw shots as well as better striking shots. Owing to the well-defined contact with the ice obtained by the bevelling, the stick is especially suitable for training the shooting capacity, because each shot can be carried out in a predetermined uniform way.

Some embodiments of a stick according to the invention have been described above. More embodiments, of course, and minor changes can be imagined without therefore abandoning the invention idea.

The design of the blade with bevelled lower side, for example, is applicable also to a stick with straight blade.

The lower side of the blade, further, can be designed concave in several ways within the scope for the overlapping concave form.

At thin blades, down to about 8 mm thickness for the lower side, the angle $\alpha$ is to be chosen in the lower part of the interval 30°–80°, so that the point 16, FIG. 3, will not be located unsuitably far away from the centre of gravity 19. The invention, thus, must not be regarded restricted to the embodiments set forth above, but can be varied within the scope of the attached claims.

I claim:

1. An ice-hockey stick comprising an elongated blade which is slightly curved in its longitudinal direction, the blade having a bottom side and two main sides, a first main side being longitudinally concave due to the curved form of the blade, the first side being the forehand side of the blade and a second main side, being longitudinally convex due to the curved form of the blade, the second side being the backhand side of the blade, characterized in that the bottom side (2) of the blade (1) is constructed to have an effective bevel shape along a substantial portion of the length of the blade (1) with the bottom side (2) sloping from the forehand side (3) to the backhand side (4) of the blade (1), so that the blade face height is less on the forehand side than on the backhand side of the blade.

2. An ice-hockey stick as defined in claim 1, characterized in that said lower side (3) is bevelled along substantially the entire length of the blade (1).

3. An ice-hockey stick as defined in claim 1, characterized in that said bevelled lower side (2) is concave in the thickness direction of the blade.

4. An ice-hockey stick as defined in claim 1, characterized in that the height difference between the forehand edge (6) and backhand edge (7) of the blade (1) formed by said bevelling is in the direction to the tip of the blade substantially constant.

5. An ice-hockey stick as defined in claim 1, characterized in that said bevelling is so adjusted along the blade that a certain plane exists, which comprises at least the forehand edge (6) and backhand edge (7) of the blade along a substantial part of the bevelled length of the blade (1), which plane forms an acute angle with the height direction (5) of the blade, whereby a well-defined position exists, where the the bevelled lower side (2) of the blade at least the forehand edge (6) and backhand edge (7), can be caused to abut the ice (10) and where the blade to a predetermined extent inclines to the forehand side (3).

6. An ice-hockey stick as defined in claim 1, characterized in that the bevelling is so adjusted along the blade (1), that a certain plane exists, which comprises the backhand edge (7) of the blade along a substantial part of the bevelled length of the blade, which plane forms an acute angle with the height direction (5) of the blade, whereby a wel-defined position exists, where the backhand edge (7) of the blade can be caused to abut the ice, whereby the blade to a predetermined extent inclines to the forehand side (3).

7. An ice-hockey stick as defined in claim 1, characterized in that said bevelling is such that the blade (1) is about 2–15 mm, preferably about 5 mm, higher on the backhand side (4) than on the forehand side (3).

8. An ice-hockey stick as defined in claim 1, characterized in that the bevelling is such, that the substantial extension direction of the lower side of the blade in cross-section perpendicular to the longitudinal direction of the blade forms an angle ($\alpha$) of 30°–80°, preferably 50°–60°, with the height direction of the blade.

9. An ice-hockey stick as defined in claim 1, characterized in that the lower portion (9) of the backhand side (4), seen in the longitudinal direction of the blade, is formed so that the impact height (18), i.e. the distance between the ice (10) and the lowermost contact point between the backhand side and a puck (15) lying on the ice at vertical position of the blade is in the direction to the tip of the blade substantially continuously increasing, along a substantial part of the blade length.

10. An ice-hockey stick as defined in claim 1, characterized in that the lower portion (9) of the backhand side (4) adjoining the backhand edge (7) is formed so that a substantially circular cross section portion (11) adjoins the backhand edge (7), which portion (11) transforms to a substantially linear portion (12) constituting a bevelling of said lower portion (9), which latter portion (12) via a substantially circular cross section portion (13) adjoins the upper portion of the backhand side.

11. An ice-hockey stick as defined in claim 1, characterized in that said bevelled lower side (2) is substantially planar.

12. An ice-hockey stick as defined in claim 1, characterized in that the height difference between the forehand edge (6) and backhand edge (7) of the blade (1) formed by said bevelling is in the direction to the tip of the blade substantially continuously increasing along a substantial part of the blade length.

13. An ice-hockey stick as defined in claim 12, characterized in that said height difference between the forehand side (3) and backhand side (4) is substantially continuously decreasing from the rear part of the blade toward its forward portion of the blade and thereafter continuously increasing to the tip.

14. An ice-hockey stick as defined in claim 1, characterized in that the height difference between the forehand edge (6) and backhand edge (7) of the blade (1) formed by said bevelling is in the direction to the tip of the blade substantially continuously decreasing along a substantial part of the blade length.

15. An ice-hockey stick as defined in claim 14, characterized in that said height difference between the forehand side (3) and backhand side (4) is substantially continuously constant to the forward portion of the blade and thereafter continuously increasing to the tip.

16. An ice-hockey stick as defined in claim 1, characterized in that the lower portion (9) of the backhand side (4), seen in the longitudinal direction of the blade, is formed so that the impact height (18), i.e., the distance between the ice (10) and the lowermost contact point between the backhand side and a puck (15) lying on the ice at vertical position of the blade is in the direction to the tip of the blade substantially constant along a substantial part of the blade length.

17. An ice-hockey stick is defined in claim 1, characterized in that the lower portion (9) of the backhand side (4), seen in the longitudinal direction of the blade, is formed so that the impact height (18), i.e., the distance between the ice (10) and the lowermost contact point between the backhand side and a puck (15) lying on the ice at vertical position of the blade is in the direction to the tip of the blade substantially continuously decreasing along a substantial part of the blade length.

* * * * *